US010295932B2

(12) United States Patent
Kanai et al.

(10) Patent No.: US 10,295,932 B2
(45) Date of Patent: May 21, 2019

(54) IMAGE FORMING APPARATUS AND CONTROL METHOD WHEREIN A DEVELOPER BEARING MEMBER IS DRIVEN AT VARIOUS SPEEDS

(71) Applicant: CANON KABUSHIKI KAISHA, Tokyo (JP)

(72) Inventors: Ryosuke Kanai, Kawasaki (JP); Tomoo Akizuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/891,030

(22) Filed: Feb. 7, 2018

(65) Prior Publication Data

US 2018/0231918 A1 Aug. 16, 2018

(30) Foreign Application Priority Data

Feb. 13, 2017 (JP) ..... 2017-024416

(51) Int. Cl.
*G03G 15/08* (2006.01)
*G03G 21/18* (2006.01)

(52) U.S. Cl.
CPC ..... *G03G 15/0882* (2013.01); *G03G 15/0806* (2013.01); *G03G 15/0856* (2013.01); *G03G 15/0865* (2013.01); *G03G 15/0891* (2013.01); *G03G 21/1814* (2013.01); *G03G 21/1889* (2013.01); *G03G 21/1892* (2013.01); *G03G 2215/0687* (2013.01)

(58) Field of Classification Search
CPC ..... G03G 15/0841; G03G 15/0882; G03G 15/0891; G03G 15/0865; G03G 2215/0687; G03G 15/0856; G03G 15/2215; G03G 15/088; G03G 15/0863; G03G 21/1878; G03G 21/1892; G03G 2215/0695; G03G 2215/0697; G03G 2221/1892
See application file for complete search history.

(56) References Cited

FOREIGN PATENT DOCUMENTS

| | | |
|---|---|---|
| JP | 2004-109461 A | 4/2004 |
| JP | 2014-071126 A | 4/2014 |

*Primary Examiner* — David M. Gray
*Assistant Examiner* — Laura Roth
(74) *Attorney, Agent, or Firm* — Canon U.S.A., Inc. I.P. Division

(57) ABSTRACT

An image forming apparatus is provided which can reduce occurrence of unusual noise. The image forming apparatus includes a driving motor configured to drive a developer bearing member and a control unit which can control the driving motor between a first driving speed and a second driving speed higher than the first driving speed. In a case where the first driving speed is equal to the driving speed of the image forming operation, the control unit controls the driving motor to drive at the second driving speed while an unsealing operation is being performed.

14 Claims, 10 Drawing Sheets

FIG. 5

| DEVELOPMENT SLEEVE DRIVING SPEED [mm/s] | WITHOUT TONER AT CONTACT PORTION | WITH TONER AT CONTACT PORTION |
|---|---|---|
| 50 | YES | NO |
| 75 | YES | NO |
| 100 | YES | NO |
| 125 | YES | NO |
| 150 | YES | NO |
| 175 | NO | NO |
| 200 | NO | NO |
| 225 | NO | NO |
| 250 | NO | NO |

NO: UNUSUAL NOISE DOES NOT OCCUR
YES: UNUSUAL NOISE OCCURS

IMAGE FORMING APPARATUS AND CONTROL METHOD WHEREIN A DEVELOPER BEARING MEMBER IS DRIVEN AT VARIOUS SPEEDS

BACKGROUND OF THE INVENTION

Field of the Invention

The present disclosure generally relates to an electrophotographic image forming apparatus.

Description of the Related Art

Conventionally, electrophotographic image forming apparatuses are well known. An electrophotographic image forming apparatus can form an image on a recording material (such as recording paper) based on an electrophotographic image forming system. Examples of such an electrophotographic image forming apparatus may include a copier, a printer, a facsimile and a multifunction peripheral (multifunction printer).

Image forming based on an electrophotographic image forming system can perform selective exposure based on image information on an electrophotographic photosensitive drum that is evenly charged by a charging device to form a latent image. The latent image is developed with toner, and a toner image that is a developer image is formed by a developing device. After that, the toner image formed on the electrophotographic photosensitive drum is transferred to a recording material by a transfer device for performing image forming.

Apparatuses have been widely available as a cartridge which integrally has a part requiring maintenance and is detachably attached to a main body of an image forming apparatus.

For example, a developing cartridge for use in electrophotographic image forming is a cartridge integrally having a developing device and detachably attached to a main body of an image forming apparatus.

A process cartridge for use in electrophotographic image forming is a cartridge integrally having an electrophotographic photosensitive drum and a processing unit which may act on the electrophotographic photosensitive drum. The process cartridge may be detachably attached to a main body of an image forming apparatus.

A cartridge has been proposed (Japanese Patent Laid-Open No. 2014-071126) which is configured to seal with a toner sealing member a toner supply opening communicating between a developer storage chamber and a development chamber.

The opening is unsealed when the toner sealing member is wound around a rotary member. After unsealing it, the toner sealing member rotates integrally with the rotary member. A conveyance sheet also attached to the rotary member conveys toner within the storage chamber to the development chamber.

The configuration disclosed in Japanese Patent Laid-Open No. 2014-071126 can prevent toner leakage from the cartridge due to vibrations or impact while it is being distributed. Furthermore, the toner sealing member staying within the cartridge may eliminate necessity for a user to perform processing on the toner sealing member. In addition, a user may not be required to pull the toner sealing member to unseal the opening for improved usability.

Another cartridge has been known which has a developing blade in contact with a development roller being a developer bearing member, wherein lubricant is applied to a contact portion between the development roller and the developing blade at an initial (new) state (Japanese Patent Laid-Open No. 2004-109461). This may reduce frictional force applied to the contact portion at the initial state.

It is an extremely short time for the development roller to rotate without toner at the contact portion in a configuration without such a toner sealing member or a configuration requiring a user to remove the toner sealing member. This is because a user operation or vibration causes toner, which is lubricant, to be supplied to the development roller when the cartridge is attached to a main body of an image forming apparatus.

However, in the configuration as disclosed in the aforementioned patent documents, the following problems may occur.

In the configuration disclosed in Japanese Patent Laid-Open No. 2014-071126, a developing blade is in contact with a development roller, and no lubricant is present at the contact portion. The development roller rotates when a rotary member rotates with the toner sealing member unsealed.

In this configuration, it takes a long time for toner to be supplied to the development roller with the opening unsealed and reach the contact portion. Then, until the toner reaches the contact portion, the frictional force between the development roller and the developing blade vibrates the developing blade, which causes unusual noise due to blade squeaking.

In the configuration disclosed in Japanese Patent Laid-Open No. 2004-109461 on the other hand, lubricant is applied to a contact portion between a developing blade and a development roller. This configuration may require not only the material cost for the lubricant but also a process for the application of lubricant to the development roller or the developing blade when they are assembled, which may increase the manufacturing cost.

SUMMARY OF THE INVENTION

Accordingly, the present disclosure generally provides an image forming apparatus including a developer bearing member configured to bear a developer, a developing blade in contact with the developer bearing member, the developing blade regulating a layer thickness of the developer on the developer bearing member, a development chamber including the developer bearing member, a developer storage chamber storing the developer and having an opening for conveying the developer to the development chamber, a sealing member configured to seal the opening;

the sealing member being capable of being moved in an interlocking manner with driving of the developer bearing member to perform an unsealing operation for unsealing the opening, a driving motor configured to drive the developer bearing member, and a control unit configured to control the driving motor to cause the developer bearing member to drive at a first driving speed while an image forming operation is being performed, wherein the control unit controls the driving motor from a time before the unsealing operation starts to a starting time to drive the developer bearing member at a second driving speed higher than the first driving speed.

Further features of the present disclosure will become apparent from the following description of exemplary embodiments with reference to the attached drawings.

BRIEF DESCRIPTION OF THE DRAWINGS

FIG. 5 illustrates results of an experiment for examining the presence or absence of unusual noise for driving speeds.

DESCRIPTION OF THE EMBODIMENTS

First Embodiment

Figure 2:
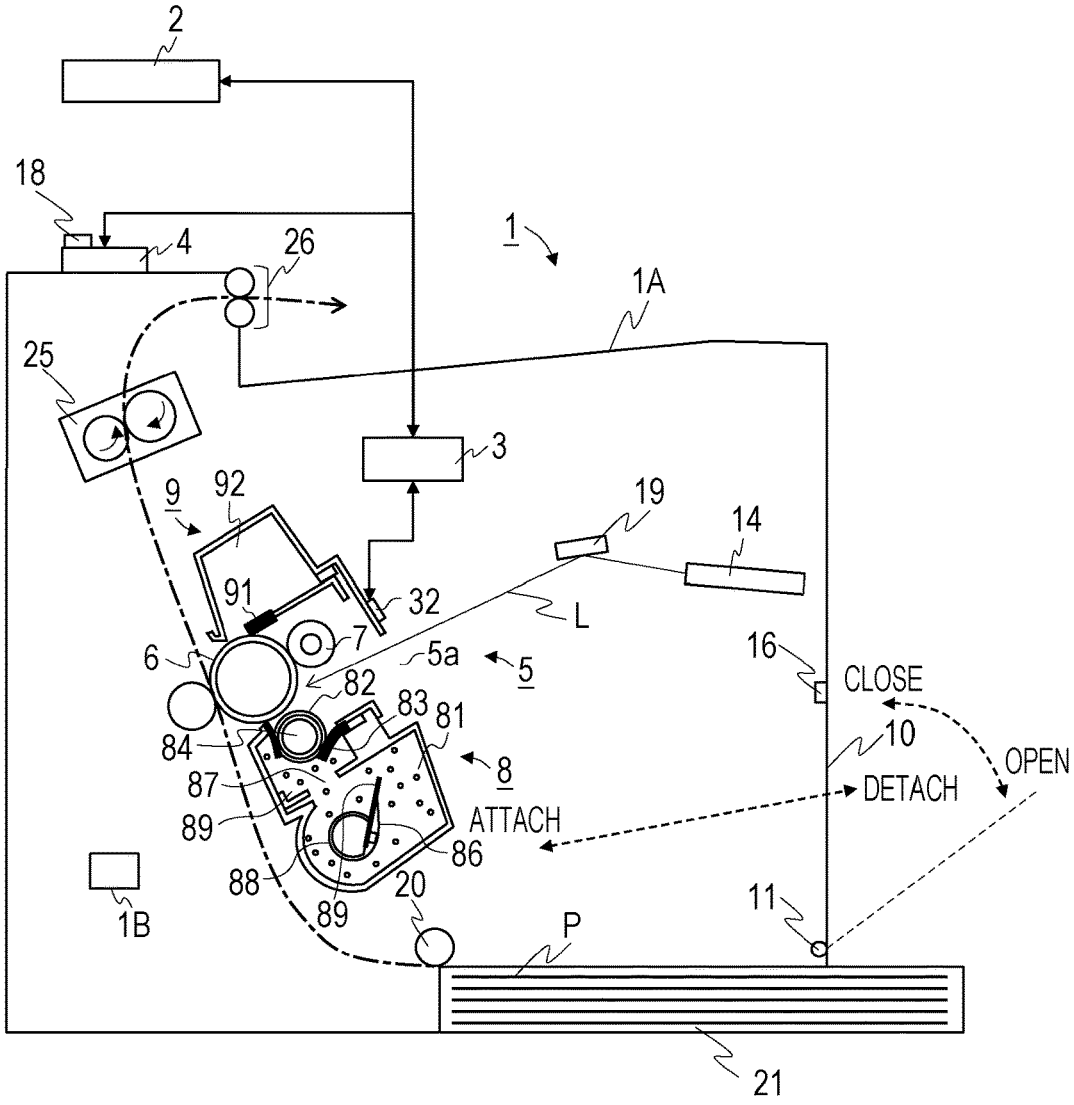
FIG. 2 is a sectional view of an image forming apparatus according to a first embodiment.

FIG. 2 is a sectional view of an image forming apparatus 1 according to a first embodiment. The image forming apparatus 1 illustrated in FIG. 2 is a cartridge type laser beam printer implementing electrophotographic processes. The image forming apparatus 1 is connected to a host apparatus 2 such as a PC and an image reader over a local area network (LAN), and electrical image information is input from the host apparatus 2 to a control circuit unit 3 (corresponding to a control unit or a CPU). The control circuit unit 3 is configured to execute image forming operations for implementing image forming on a sheet-shaped recording material P based on the input electrical image information. The control circuit unit 3 is configured to exchange electrical information with the host apparatus 2 and an operating portion 4 and to generally control image forming operations in the image forming apparatus 1 based on a predetermined control program or a reference table.

The following descriptions assume that a widthwise direction of the cartridge 5 (or a process cartridge according to the first embodiment) is a direction for attaching/detaching the cartridge 5 to/from a main body 1A of the image forming apparatus 1. It is also assumed that a longitudinal direction of the cartridge 5 is a direction intersecting the direction for attaching/detaching the cartridge 5 to/from the main body 1A. Referring to FIG. 2, the longitudinal direction of the cartridge is vertical to FIG. 2, and the widthwise direction of the cartridge is parallel to FIG. 2.

The cartridge 5 according to this embodiment is a process cartridge integrally including a photoconductive drum 6 and an electrophotographic processing unit. The photoconductive drum 6 is a rotatable image bearing unit, and the electrophotographic processing unit performs actions on the photoconductive drum 6. The electrophotographic processing unit may include a charging device 7, a developing device 8, and a cleaning device 9. The cartridge 5 is attachable and removable (detachable) to and from the main body 1A. According to this embodiment, the photoconductive drum 6 is a rotating drum type, electrophotographic photosensitive member.

The charging device 7 is configured to evenly charge a surface of the photoconductive drum 6 to a predetermined polarity/potential. The charging device 7 has a charging roller in contact with the surface of the photoconductive drum 6. The developing device 8 is configured to develop with a developer T an electrostatic image formed by an exposure device 14 on the surface of the photoconductive drum 6. The cleaning device 9 is configured to remove residual toner from the surface of the photoconductive drum 6. The cleaning device 9 has a cleaning blade 91 in contact with the surface of the photoconductive drum 6.

In the cartridge 5, the photoconductive drum 6, the charging device 7, the developing device 8, and the cleaning device 9 are assembled in a predetermined mutual arrangement relationship.

According to this embodiment, the cartridge 5 can be attached or detached by opening a door 10 being an opening/closing member of the main body 1A about a hinge 11 as illustrated in the broken line in FIG. 2 to open the interior of the main body 1A. When the cartridge 5 is fully inserted to the main body 1A, the cartridge 5 is held at a predetermined attachment position so that the opening 5*a* of an upper surface of the cartridge 5 faces a folding mirror 19 of an exposure device 14 being an information writing unit (exposure device). A lower surface of the photoconductive drum 6 exposed from the lower surface of the cartridge 5 is set to face a transfer roller 15.

The main body 1A has a door switch 16 (safe switch, kill switch). The door switch 16 is turned off when the door 10 of the main body 1A is opened and is turned on when the door 10 is closed.

The cartridge 5 is attached at a predetermined position of the main body 1A. When the door 10 is closed, the cartridge 5 is mechanically and electrically connected with the main body 1A. Thus, driven members in the cartridge 5 (such as the photoconductive drum 6 being an image bearing member, a developing sleeve 82 being a developer bearing member, and an axis of rotation 88) can be driven by a driving motor 1B in the main body 1A. The driven members in the cartridge 5 (such as the photoconductive drum 6 being an image bearing member, a developing sleeve 82 being a developer bearing member, and an axis of rotation 88) can be driven from a driving motor 1B provided in the main body 1A through a drive transmission member such as a gear. The OFF/ON switching and the driving speed at an ON state of a driving motor 1B being a driving device for the main body 1A are controlled by the control circuit unit 3 being a control unit. The driving speed can be controlled to be switched between at least two driving speeds but may be controlled among three or four driving speeds. According to this embodiment, the driving speed can be controlled to be switched between two driving speeds. According to this embodiment, the developing sleeve 82 can have two surface speeds. In this case, when the driving motor 1B drives at a first driving speed, the developing sleeve is controlled to have a surface speed of 100 mm/s. When the driving motor 1B drives at a second driving speed higher than the first driving speed, the developing sleeve is controlled to have a surface speed of 200 mm/s. Here, the first driving speed corresponds to a driving speed while an image forming operation is being performed. The first driving speed and the second driving speed are proportional to the surface speeds of the developing sleeve being a developer bearing member and the corresponding surface speeds of the developing sleeve will be called a first sleeve driving speed and a second sleeve driving speed, respectively.

Sensors, etc. in the cartridge 5 are electrically in communication with the control circuit unit 3 in the main body 1A. A predetermined bias can be applied from a bias applying power supply unit in the main body 1A to the charging roller 7 and the developing sleeve 82 in the cartridge 5.

In the image forming apparatus 1, a main power supply switch 18 in the operating portion 4 is turned on (power ON). When the cartridge 5 is attached to the main body 1A and when the door 10 is closed to turn on the switch 16, the image forming apparatus 1 has a standby state, ready for image forming operations.

At the standby state, if electrical image information to be printed is input from the host apparatus 2 to the control circuit unit 3, image forming is sequentially started. The control circuit unit 3 processes the input image information in an image processing unit and executes an image forming process in response to an image forming start signal (print start signal). In other words, the driving motor is activated, and the photoconductive drum 6 is driven to rotate at a predetermined speed (process speed) in clockwise direction indicated by an arrow.

The photoconductive drum 6 which has been driven to rotate has its surface charged evenly to a predetermined polarity and potential by the charging roller 7. According to this embodiment, a charging bias having AC voltage and DC voltage thereon is applied to the charging roller 7 by the charging bias applying power supply. The charging bias to be applied to the charging roller 7 may have DC voltage only. After charged, the photoconductive drum 6 undergoes laser scanning exposure by the exposure device 14. Laser light L is reflected by the folding mirror 19 and enters through the opening 5*a* into the cartridge 5 so that an electrostatic image can be formed on the charged surface of the photoconductive drum 6. The electrostatic image is developed as a toner image with toner T supplied from the developing device 8.

According to this embodiment, image exposure is performed on the exposure device 14 for exposing an image to which toner T being a developer is to be transferred so that an electrostatic image can be formed on the photoconductive drum 6. The electrostatic image undergoes reversal development by a developing device based on a jumping develop system using negatively charged magnetic single-component toner (negative toner).

The developing device 8 has a developer storage chamber 81 and a development chamber 85. The development chamber 85 has a developing sleeve 82 being a developer bearing member and a developing blade 83 being a regulating member configured to regulate a layer thickness of a developer on the developer bearing member. The development chamber has a magnet roller 84 fixed within the developing sleeve 82. The developer storage chamber 81 stores toner T and has an opening communicating to the development chamber for supplying toner T to the development chamber.

Figure 3:
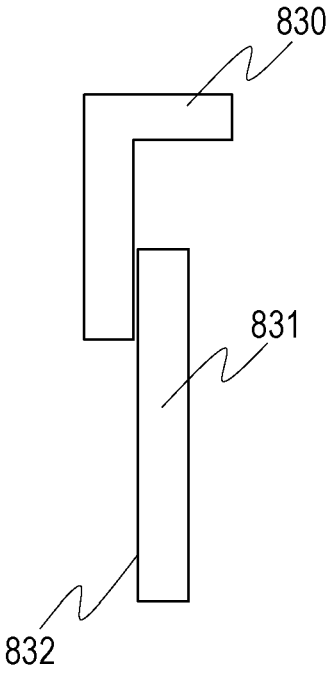
FIG. 3 is a schematic diagram illustrating a developing blade.

FIG. 3 is a sectional view of the developing blade 83. The developing blade 83 has a supporting plate 830 and a rubber member 831. The supporting plate 830 and the rubber member 831 can be attached and be fixed by using a hot melt tape, for example. The rubber member 831 has a contact surface 832 abutted against the developing sleeve 82. The rubber member 831 has the contact surface 832 abutted into belly contact in counterclockwise direction with the developing sleeve 82 at a predetermined position (contact portion) so that the toner T on the developing sleeve can have a proper layer thickness. Though the rubber member 831 according to this embodiment is made of polyurethane rubber, the rubber member 831 may be made of any material or any rubber. The rubber member 831 may be approximately 1.0 mm thick and may have a contact pressure of 10 to 30 gf/cm against the developing sleeve 82. The corresponding contact surface may have a 10-point roughness average Rz=2 to 10 μm (JIS-B0601 1994).

The new cartridge 5 according to this embodiment does not have lubricant particles applied on a contact portion between the developing sleeve 82 and the developing blade 83 (rubber portion 831). Here, the developing sleeve 82 has a sleeve contact portion, and the developing blade 83 has a blade contact portion.

The new cartridge 5 is unused from a time when the cartridge 5 is shipped from factory to a time when the cartridge 5 is attached to the main body 1A and is started to be used for image forming.

The cartridge 5 has a memory being a storage member configured to store information regarding the cartridge 5. After the cartridge 5 is attached to the main body and before image forming operations are started, a detecting unit in the main body obtains information stored in the memory and detects whether the cartridge is new or not from the obtained information. According to this embodiment, the control unit also functions as the detecting unit.

The memory may store not only information regarding whether the cartridge is new or not but also the date of manufacture of the cartridge and information relating to the cartridge such as characteristics of toner accommodated in the cartridge. The information regarding whether the cartridge is new or not herein corresponds to usage history of the developing sleeve 82. If the usage history is zero, it means that the cartridge is new. Information stored in the memory 32 is transmitted to the control circuit unit 3. The control circuit unit 3 being a control unit determines whether the developing sleeve 82 is new or not based on usage history of the developing sleeve 82 stored in the memory 32 after the image forming apparatus 1 is powered on. If it is determined as being new (or if the usage history is zero), an initial rotation mode is executed which rotates at least the developing sleeve 82.

The developing sleeve 82 is parallel to the photoconductive drum 6 and faces the photoconductive drum 6 with a predetermined small gap between the developing sleeve 82 and the photoconductive drum 6. The developing sleeve 82 is driven at a predetermined speed in counterclockwise direction indicated by an arrow in an interlocking manner with the rotation of the photoconductive drum 6.

The developing sleeve 82 according to this embodiment is a hollow aluminum base having its surface coated with a conductive resin. The surface of the developing sleeve 82 according to this embodiment has an arithmetic average roughness Ra=1 to 3 μm (JIS-B0601 1994).

The developer storage chamber 81 internally has a sheet-shaped conveying member 89. The conveying member 89 is attached to the axis of rotation 88 and rotates at a predetermined speed in an interlocking manner with the rotation of the developing sleeve 82 so that toner T within the developer storage chamber 81 can be supplied to the development chamber 85 and the developing sleeve 82. The conveying member 89 is not limited to have a sheet shape but may be blade-shaped.

Because of magnetic force of the magnet roller 84, the toner T is magnetically absorbed to be bore on a surface close to the development chamber 85 of the developing sleeve 82. The rotation of the developing sleeve 82 then conveys the toner to a development region facing the photoconductive drum 6. The toner T while being conveyed passes through the contact portion between the developing sleeve 82 and the developing blade 83. Thus, a proper amount of the toner T by under layer thickness regulation is applied onto the developing sleeve 82 and is triboelectrically charged to a negative polarity. The subsequent rotation of the developing sleeve 82 conveys the toner T to a development region facing the photoconductive drum 6.

The development bias power supply provided in the main body 1A applies a predetermined development bias to the developing sleeve 82 through a sliding contact. According to this embodiment, the toner on the developing sleeve 82 flies to the photoconductive drum 6 to be electrostatically transferred to an electrostatic image on the development region so that the electrostatic image can be developed as a toner image.

On the other hand, the control circuit unit 3 drives a feeding roller 20 to rotate at a predetermined controlled time. This separately feeds, one by one, recording materials P stacked within a cassette 21. The recording material P is fed through a guide plate and reaches a registration roller pair whose rotation is ON/OFF controlled at predetermined controlled times. The registration roller pair at the rotation OFF state temporarily receives a leading edge of the recording material P and corrects the skewing of the recording material P. When the rotation of the registration roller pair is turned on at a predetermined controlled time, the recording material P is introduced to a transfer nip portion being a contact portion between the photoconductive drum 6 and the transfer roller 15.

In other words, the recording material P is fed by the registration roller pair to the transfer nip portion in synchronization with the toner image on the photoconductive drum 6. While the recording material P is being pinched and conveyed through the transfer nip portion, a transfer bias having a predetermined potential of a polarity (positive polarity according to the this embodiment) opposite to the charging polarity of the toner is applied to the transfer roller 15 by the transfer bias power supply. Thus, the toner image on the surface of the photoconductive drum 6 is sequentially and electrostatically transferred to a surface of the recording material P.

The recording material P exiting from the transfer nip portion is separated from the surface of the photoconductive drum 6 and is introduced to a fixing device 25 (fixing unit) through the conveying device. The recording material P introduced to the fixing device 25 is heated and pressed so that the unfixed toner image is fixed to the surface of the recording material as a fixed image. The recording material P is discharged to outside of the apparatus by a discharge roller pair 26.

On the other hand, after the surface of the photoconductive drum 6 after the recording material P is separated, it is cleaned by removing residual deposits such as residual toner by a cleaning blade 91 in the cleaning device 9 for repetitive use in the image formation. The residual toner, etc. removed from the drum surface by the cleaning blade 91 is accommodated in a residual toner container 92.

Figure 4A:
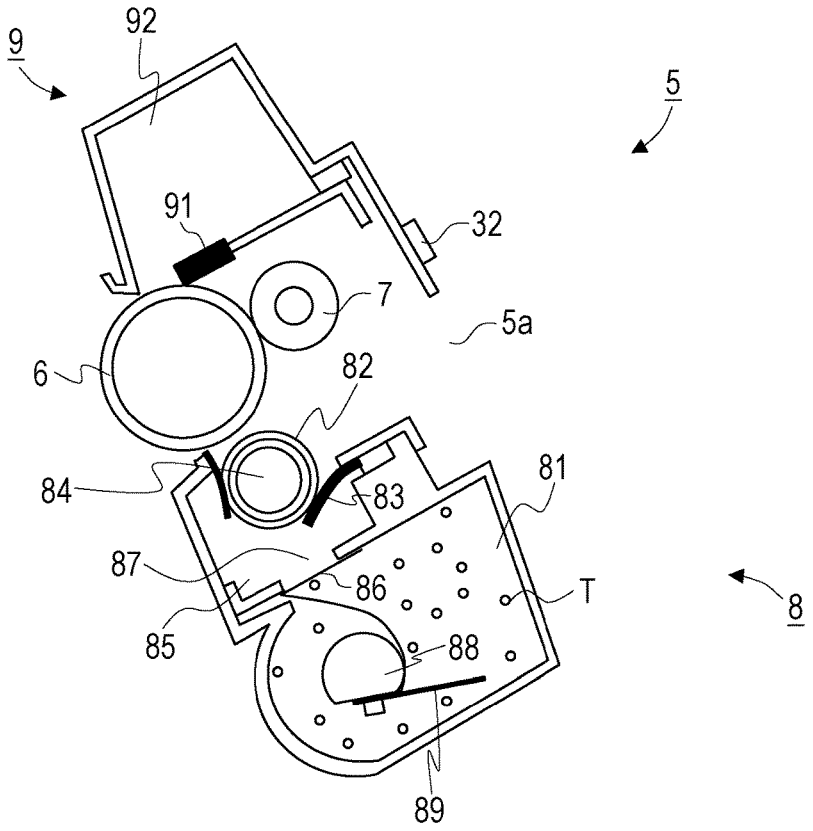
FIGS. 4A and 4B are a sectional view of a cartridge according to the first embodiment.
Figure 4B:
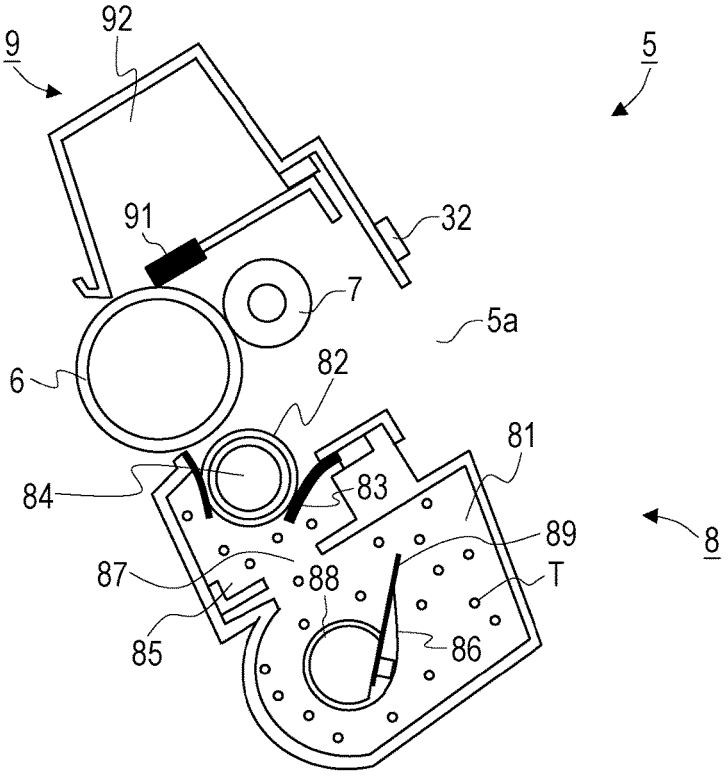

FIG. 4A is a sectional view of the new cartridge 5 before the toner sealing member 86 being a sealing member is unsealed. The developing device 8 has the developer storage chamber 81 which stores toner T and the development chamber 85 having the developing sleeve 82 as a developer bearing member configured to develop an electrostatic image on a surface of the photoconductive drum 6 with toner T. The developer storage chamber 81 has a communication port for conveying toner T to the development chamber 85. The toner sealing member 86 being a sealing member which seals toner T and can be unsealed when the toner T is used is placed between the developer storage chamber 81 and the development chamber 85 and divides the storage chamber and the development chamber. Each of the developer storage chamber 81 and the development chamber 85 is configured by a frame. Referring to FIGS. 4A and 4B, two frames of a first frame and a second frame are bonded to form the developer storage chamber 81 and the development chamber 85. Either one of the first frame and the second frame has the communication port.

In the new cartridge 5, toner T is sealed by the toner sealing member 86 being a sealing member within the developer storage chamber 81 to prevent the toner T from flowing into the development chamber 85. This also prevents leakage of the toner T when the new cartridge 5 is transported. In the new cartridge 5, lubricant particles providing a lubricating effect between the developing blade 83 and the developing sleeve 82 are not applied.

The toner sealing member 86 being a sealing member according to this embodiment is sheet-shaped and seals the opening 87 by welding or adhering. The toner sealing member being a sealing member according to this embodiment has the other end fixed to the axis of rotation 88. The rotation of the axis of rotation 88 peels a lower end side of the toner sealing member 86 with respect to the opening 87 so that the opening 87 can be partially unsealed. When an upper end side of the toner sealing member 86 with respect to the opening 87 is peeled, the toner sealing member 86 is completely unsealed so that the opening 87 can be completely unsealed. When the opening 87 is unsealed, partial toner T can be moved to the development chamber 85.

A conveying member 87 which conveys toner is fixed to the axis of rotation 88 in addition to the toner sealing member 86. Therefore, the axis of rotation 88 also functions as an unsealing member. The conveying member 87 according to this embodiment is a sheet-shaped member made of PPS. The rotation of the axis of rotation 88 rotates the conveying member 87 so that the toner T can be conveyed from the developer storage chamber 81 to the development chamber 85 through the opening 87. The axis of rotation 88 rotates in an interlocking manner with the photoconductive drum 6 and the developing sleeve 82. In other words, the unsealing of the toner sealing member 86 interlocks with the rotation of the developing sleeve 82. The interlocking includes, when the driving motor 1B is driven, transmitting the drive of the coupling in the main body to a developing coupling gear being a drive transmission member. The drive is transmitted from the developing coupling gear to the developer bearing member, and the drive is transmitted from the developing coupling gear to a drive gear being a drive transmission member. The driving is then transmitted from the drive gear to the axis of rotation. In this manner, when the driving motor 1B is driven, the developing sleeve being a developer bearing member and the axis of rotation to which the toner sealing member is attached are driven (rotated).

According to this embodiment, the toner sealing member 86 is wound around the axis of rotation 88 within the developer storage chamber 81 to be moved to unseal the opening. However, embodiments of the present disclosure are not limited to the configuration, but the toner sealing member 86 may be moved to unseal the opening in an interlocking manner with the rotation of the developing sleeve 82 being a developer bearing member. For example, an axis of rotation may be provided which interlocks with the rotation of the developing sleeve 82 within the development chamber 85, and the toner sealing member 86 may be wound around the axis of rotation for the unsealing. According to this embodiment, the axis of rotation extends in the longitudinal direction of the cartridge. However, the axis of rotation may extend in the widthwise direction of the cartridge.

FIG. 4B is a sectional view of the cartridge 5 after the toner sealing member 86 is unsealed. When the toner T is conveyed to the development chamber 85 and the developing sleeve 82 is coated by the toner T up to a predetermined layer thickness, the cartridge 5 is ready for image forming.

Next, unusual noise due to developing blade squeaking will be described.

In the new cartridge 5, lubricant particles which provide a lubricating effect are not applied to the contact portion between the developing blade 83 and the developing sleeve 82. In other words, a larger frictional force is produced when the developing sleeve 82 is driven. With such a larger frictional force, the developing blade 83 may vibrate because of some driving speeds of the driving of the developing sleeve 82. As a result unusual noise may occur due to developing blade squeaking.

FIG. 5 illustrates experiment results showing a relationship between driving speeds of the developing sleeve 82 and occurrence of unusual noise when toner T is not present at the contact portion between the developing blade 83 and the developing sleeve 82 and when the toner T is present at the contact portion.

When the toner T being a lubricant is present at the contact portion, the developing blade 83 receives a smaller frictional force generated by the driving of the developing sleeve 82. Therefore, unusual noise due to squeaking of the developing blade 83 does not occur independently of the driving speed of the developing sleeve 82.

When the toner T is not present at the contact portion and when the driving speed of the developing sleeve 82 is equal to or lower than 150 mm/s, the developing blade 83 vibrates and unusual noise due to developing blade squeaking occurs as a result. If the driving speed of the developing sleeve 82 is higher than 175 mm/s, the vibration of the developing blade 83 can be inhibited, and unusual noise due to developing blade squeaking does not occur.

According to this embodiment, the driving speed of the developing sleeve 82 during an image-forming period (where the driving motor drives at a first driving speed) is equal to 100 mm/s. If the toner sealing member 86 performs the unsealing operation when the developing sleeve 82 drives at 100 mm/s, unusual noise occurs. According to this embodiment, the toner sealing member 86 performs the unsealing operation when the developing sleeve 82 drives at 200 mm/s (where the driving motor drives at a second driving speed), no unusual noise occurs.

The toner sealing member 86 performs the unsealing operation during an initial rotation operation.

Figure 6:
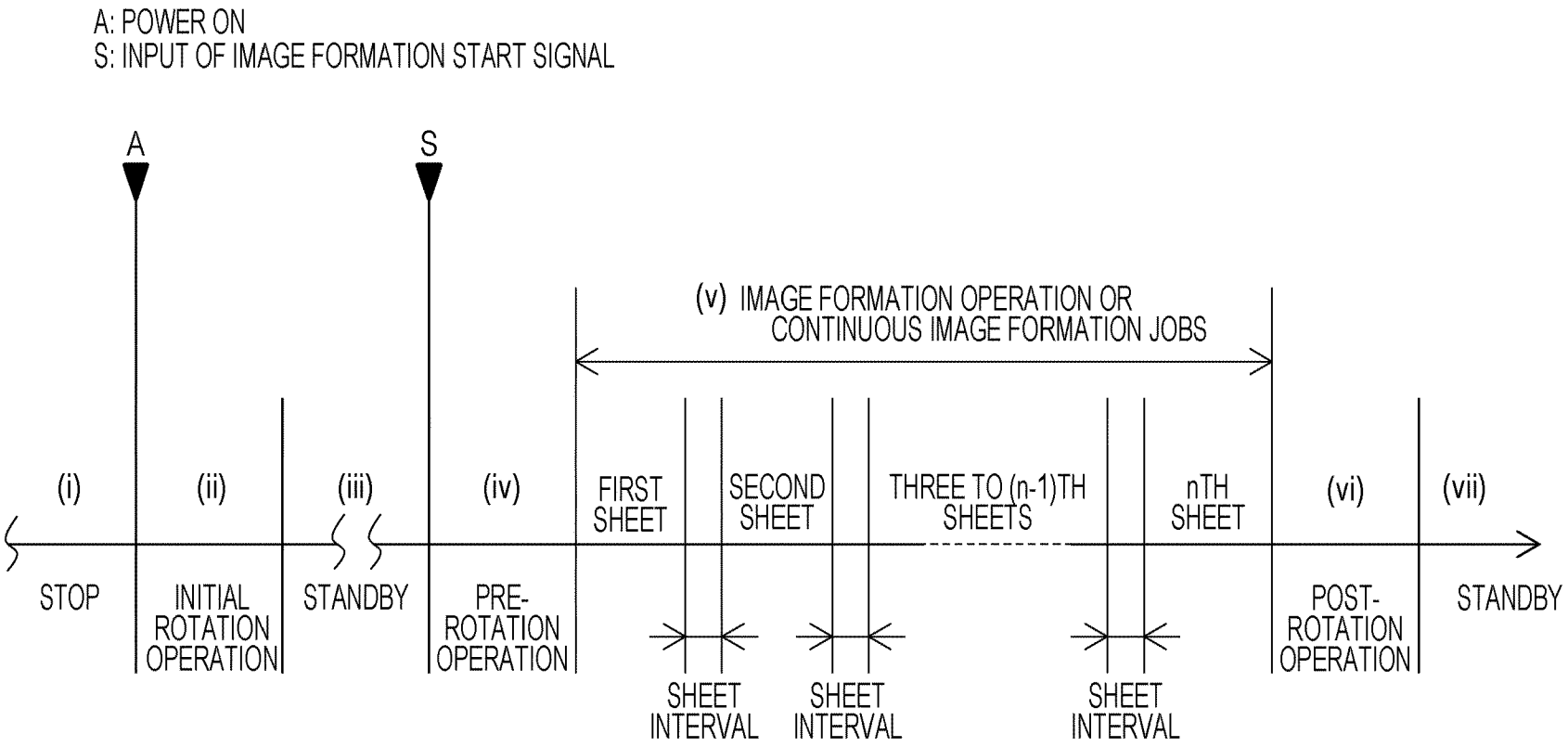
FIG. 6 illustrates operating steps to be performed by an image forming apparatus.

FIG. 6 is an operating step diagram for the image forming apparatus 1.

(i) Stop State

When the image forming apparatus 1 is powered off, that is, when the main power supply switch 18 has an OFF state or when the door 10 is opened and the switch 16 has an OFF state, the power supply circuit is open (power OFF), and the image forming apparatus is held at a stop state.

(ii) Initial Rotation Operation (Multiple Pre-Rotation Operation)

An initial rotation operation (operation upon activation is to be executed when the image forming apparatus 1 is powered on. In other words, the operation is performed for warming a necessary processing device involving driving to rotate the photoconductive drum 6 when the image forming apparatus is powered on and the driving motor 1B is activated.

The time when the image forming apparatus 1 is powered on corresponds to the main power supply switch 18 is shifted from an OFF state to an ON state when the door switch 16 has an ON state (with the door 10 closed). Alternatively, the time corresponds to a time when the switch 16 is shifted from an OFF state (with the door 10 open) from an ON state (with the door 10 closed) when the main power supply switch 18 has an ON state. In both of the cases, the power supply circuit is closed (powered ON), the image forming apparatus 1 is held at an operable state.

The initial rotation operation corresponds to a preparation operation for causing the image forming apparatus 1 to execute stable image forming. For example, when a state of the cartridge 5 is detected, it may be controlled to determine a proper charge, develop, and transfer bias settings based on the detected state. Alternatively, processing control may be performed to apply a constant charging bias or to irradiate light for exposure for obtaining a uniform surface potential of the photoconductive drum 6.

(iii) Standby (Wait)

When a predetermined initial rotation operation ends, the driving of the driving motor 1B is stopped, and the image forming apparatus 1 is held at a standby state until an image forming start signal S is input.

(iv) Pre-Rotation Operation

In response to the input of the image forming start signal S, the driving motor 1B is driven again, and a predetermined pre-operation for image forming involving driving to rotate the photoconductive drum 6 is executed.

More specifically, in order, a: the control circuit unit 3 receives the image forming start signal S, b: the corresponding image is decompressed by a formatter (in a decompression time depending on the amount of data of the image or the processing speed of the formatter), and then c: the pre-rotation operation is started. When the image forming start signal S is input while the initial rotation operation in (ii) is being performed, the pre-rotation operation in (iv) is sequentially executed without the standby in (iii) after the initial rotation operation ends.

(v) Image Forming Operation

After the pre-rotation operation ends, an image forming operation (monochromatic print) for a predetermined recording material P or an image forming operation (continuous image forming job: multiprint) for a predetermined plurality of recording materials P are sequentially executed. Then, the image-formed recording material or materials P are output. The term "sheet interval" hereinafter refers to an interval between a rear edge of a recording material P and a leading edge of the next recording material P in a continuous image forming job.

The terms "operation period" and "operation time" refer to "image forming period" and "image forming time", respectively, hereinafter.

(vi) Post-Rotation Operation

After an image forming operation for a predetermined recording material P or for a predetermined plurality of recording materials P ends, the driving motor 1B is sequentially driven for a predetermined time so that a predetermined image forming ending operation can be executed involving driving of the photoconductive drum 6 to rotate.

(vii) Standby

After the post-rotation operation ends, the driving of the driving motor 1B is stopped, and the image forming apparatus 1 holds its standby state until the next image forming start signal S is input thereto. When the next image forming start signal S is input thereto, the pre-rotation operation in (iv) is started.

Figure 1:
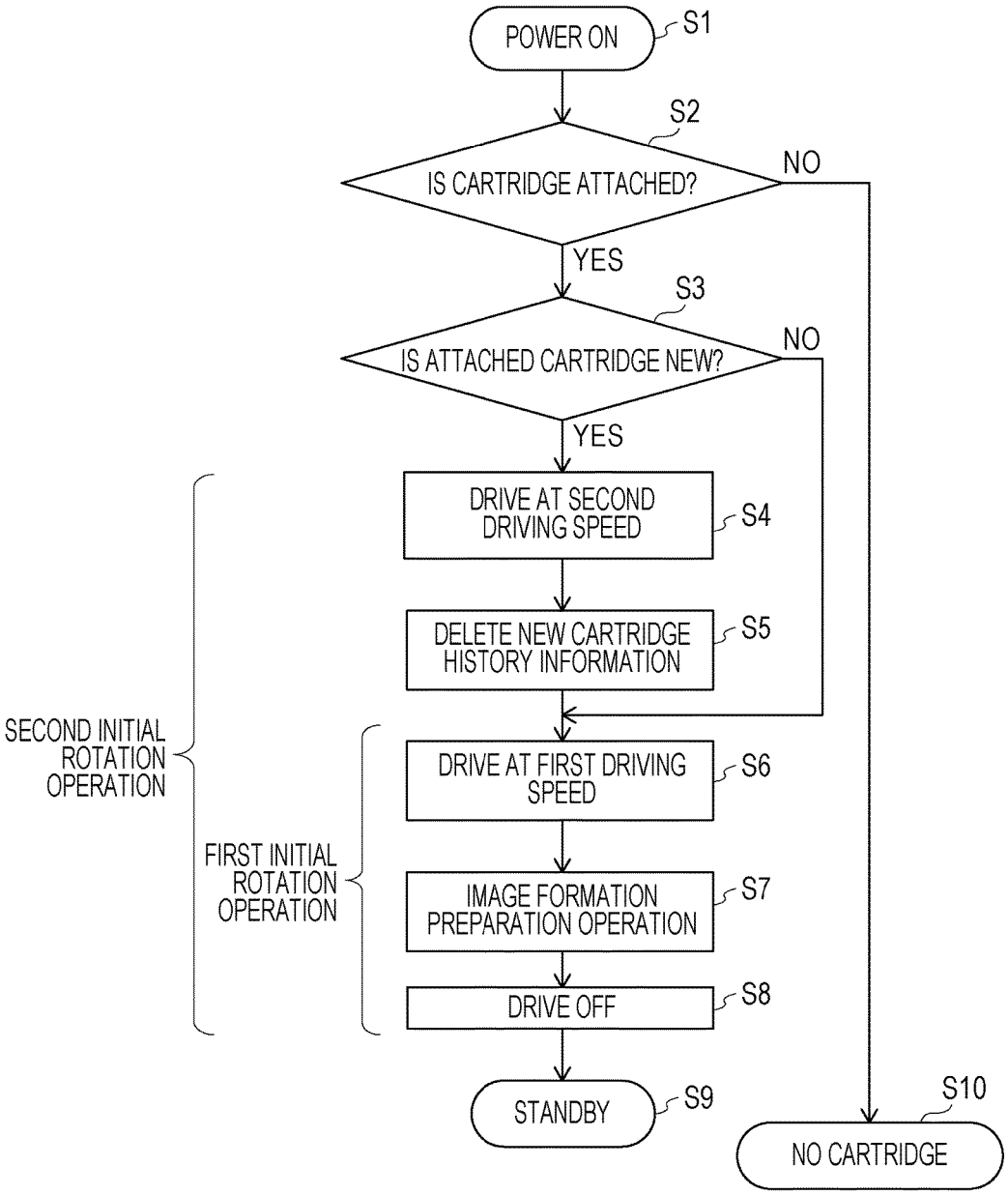
FIG. 1 is a flowchart according to the present disclosure.

Next, with reference to FIG. 1, a sequence for an initial rotation operation will be described.

When the image forming apparatus is powered on in S1, the control circuit unit 3 detects whether the cartridge 5 is attached to the image forming apparatus or not. According to this embodiment, the attachment of the cartridge 5 is determined based on communication between the control circuit unit 3 and the memory 32. If the control circuit unit 3 and the memory 32 can communicate with each other, it is determined that the cartridge 5 is attached. If not, it is determined that the cartridge 5 is not attached.

If it is determined that the cartridge 5 is not attached, the control circuit unit 3 moves to S10 where the control circuit unit 3 notifies the host apparatus 2 of that the cartridge 5 is not attached.

If it is determined that the cartridge 5 is attached, the control circuit unit 3 moves to S3 where a detecting unit in the control circuit unit 3 determines a new cartridge is attached with reference to usage history of the developing sleeve 82 stored in the memory 32.

If the control circuit unit 3 determines that a new cartridge is attached, the control circuit unit 3 advances the processing to S4. The image forming apparatus then executes a second initial rotation operation (S4 to S8). If the control circuit unit 3 determines that the attached cartridge is not new, the control circuit unit 3 advances the processing to S6. The image forming apparatus then executes a first initial rotation operation (S6 to S8).

In the second initial rotation operation, the control circuit unit 3 first in S4 drives the developing sleeve 82 at a second sleeve driving speed higher than a first sleeve driving speed. The driving speed of the developing sleeve 82 is a speed at which unusual noise due to developing blade squeaking does not occur. When the developing sleeve 82 is driven at the second sleeve driving speed, unusual noise does not occur without lubricant particles at the contact portion between the developing blade 83 and the developing sleeve 82. The driving of the developing sleeve 82 interlocks with the driving of the axis of rotation 88. This driving moves the toner sealing member 86 to unseal the opening. The toner sealing member 86 is wound around the axis of rotation 88 to unseal the opening 87. Thus, the toner T can be conveyed from the developer storage chamber 81 to the development chamber 85. When the toner T is conveyed to the development chamber 85, is supplied to the developing sleeve 82 and is conveyed to the contact portion with the developing blade 83, unusual noise does not occur irrespective of the driving speed.

The time period from the unsealing of the toner sealing member 86 to the supply of the toner T to the contact portion between the developing blade 83 and the developing sleeve 82 (or the distance of rotation of the developing sleeve 82) depends on the configuration of the cartridge 5. Therefore, the driving time at the second driving speed in S4 is set based on the configuration of the cartridge 5.

After a lapse of a preset time, the control circuit unit 3 advances the processing to S5 where new cartridge history information stored in the memory is deleted. According to this embodiment, usage for several seconds is stored in usage history relating to the developing sleeve in the memory so that the new cartridge history information can be deleted. Next, the control circuit unit 3 advances the processing to S6 where the driving motor 1B is controlled such that the developing sleeve 82 can be driven at the first driving speed. In this case, because the toner T is present as a lubricant at the contact portion between the developing sleeve 82 and the developing blade 83, unusual noise does not occur when the developing sleeve 82 is driven at the first driving speed.

Next, in S7, the image forming apparatus executes an image forming preparation operation. According to this embodiment, the image forming preparation operation corresponds to control for determining charge, develop, transfer bias settings based on a state of the cartridge 5 detected by the control circuit unit 3. The image forming preparation operation may be executed at a driving speed during the image-forming period.

After the image forming preparation operation is executed, the control circuit unit 3 turns of the driving (S8), and the image forming apparatus is shifted to the standby state (S9).

On the other hand, if the control circuit unit 3 determines in S3 that the attached cartridge 5 is not new, the control circuit unit 3 causes the image forming apparatus to perform the first initial rotation operation. The control circuit unit 3 in S6 controls the driving motor 1B to drive the developing sleeve 82 at the first driving speed. After the image forming apparatus executes the image forming preparation operation in S7, the control circuit unit 3 turns off the driving (S8) and causes the image forming apparatus to shift to the standby state (S9).

Figure 7A:
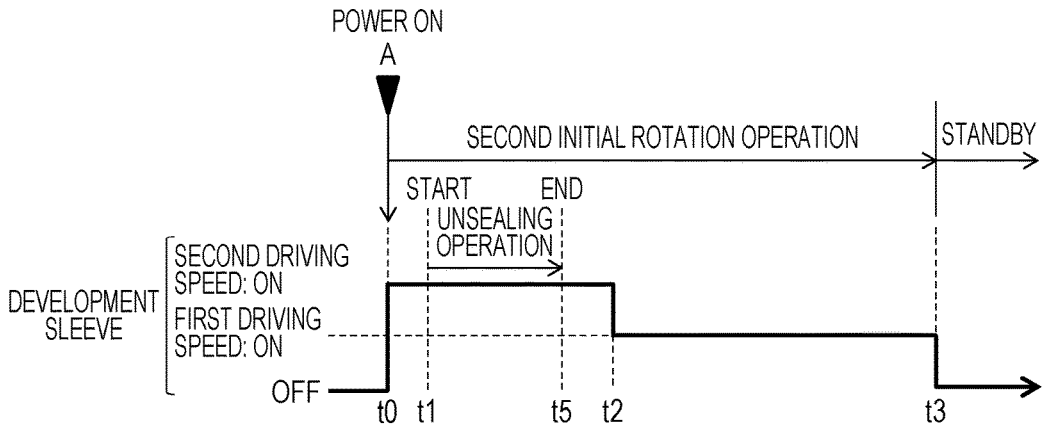
FIGS. 7A and 7B are timing charts for initial rotation operations according to the first embodiment.
Figure 7B:
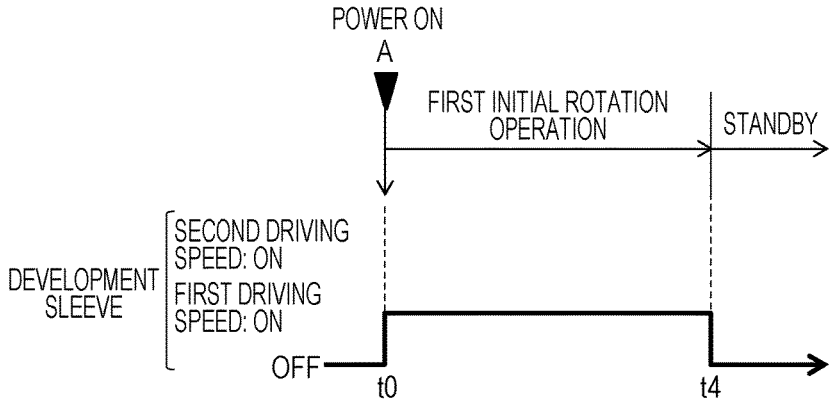

FIG. 7A and FIG. 7B are timing charts for the second initial rotation operation and the first initial rotation operation, respectively.

In the first initial rotation operation, when the image forming apparatus is powered on, the developing sleeve 82 rotates at the first sleeve driving speed (where the driving motor drives at the first driving speed) so that the image forming preparation operation is executed during a time period from t0 to t4.

In the second initial rotation operation, the unsealing of the toner sealing member 86 is started from t1. The unsealing operation starts at t1. Therefore, the time before t1 is a time before the unsealing operation is started, and the time after t1 is a time after the unsealing operation is started. During a time period between t1 and t5, the unsealing operation is performed which peels the toner sealing member from the frame. The time period will be called an unsealing operation time period or an unsealing operation time. Because the peeling process which peels the toner sealing member 86 from the frame completes at t5 and the unsealing of the opening completes, the unsealing operation ends. Here, the time before t5 is a time before completion of the unsealing, and the time after t5 is a time after completion of the unsealing. At t1, when the unsealing operation starts, the driving motor is to be driven at the second driving speed such that the surface speed of the developing sleeve can be equal to the second sleeve driving speed. According to this embodiment, because the driving of the developing sleeve is started before the unsealing operation, the frictional sliding between the developing sleeve and the developing blade starts before t1 when the unsealing operation starts. Therefore, the driving motor 1B is to be driven at the second driving speed from the time before start of the unsealing operation to the time when the unsealing operation starts.

At t2 after the unsealing operation completes (t5), the driving speed of the driving motor 1B is changed to the first driving speed being a speed in the image-forming period and being lower than the second driving speed. The corresponding driving speed of the developing sleeve is changed from the second sleeve driving speed to the first sleeve driving speed. The time t2 is set after a predetermined time period for bringing the toner T as a lubricant to the contact portion between the developing sleeve 82 and the developing blade 83. After the image forming preparation operation ends, the image forming apparatus has a standby state. When the image forming start signal S is input in the standby state, image forming is performed at the first driving speed. A lower driving speed is selected because the driven member more easily deteriorates if the driving speed is higher. However, embodiments of the present disclosure are not limited thereto, but the driving motor may be driven at the second driving speed from the time t0 when the image forming apparatus is powered on to a time before the image forming operation, and the driving motor may be driven at the first driving speed during the image forming operation.

This embodiment can provide an image forming apparatus at low cost with improved usability which does not require a user to unseal the toner sealing member and which can prevent occurrence of unusual noise.

The image forming apparatus can prevent vibration of the developing blade when a cartridge attached thereto is initially used (when a new cartridge is attached) and can prevent occurrence of unusual noise.

Second Embodiment

A second embodiment of the present disclosure will be described in detail below with reference to drawings. Like numbers refer to like parts in the first and second embodiments, and repetitive descriptions will be omitted.

Figure 8:
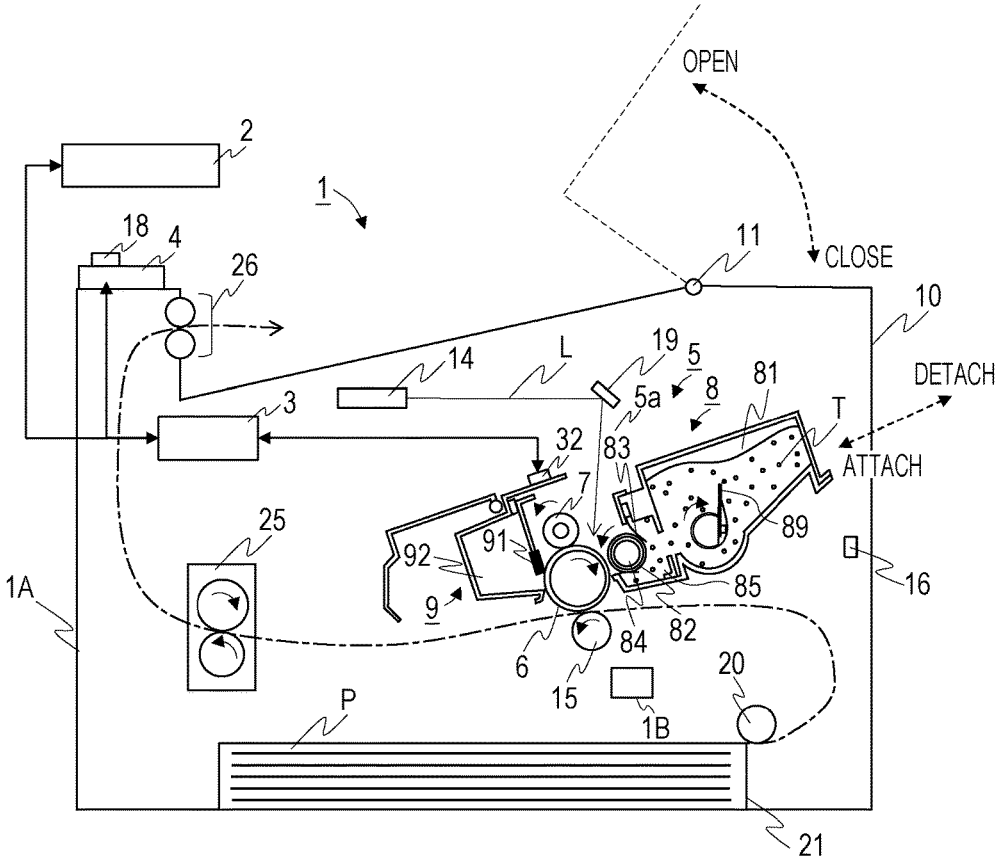
FIG. 8 is a sectional view of an image forming apparatus according to a second embodiment.
Figure 9A:
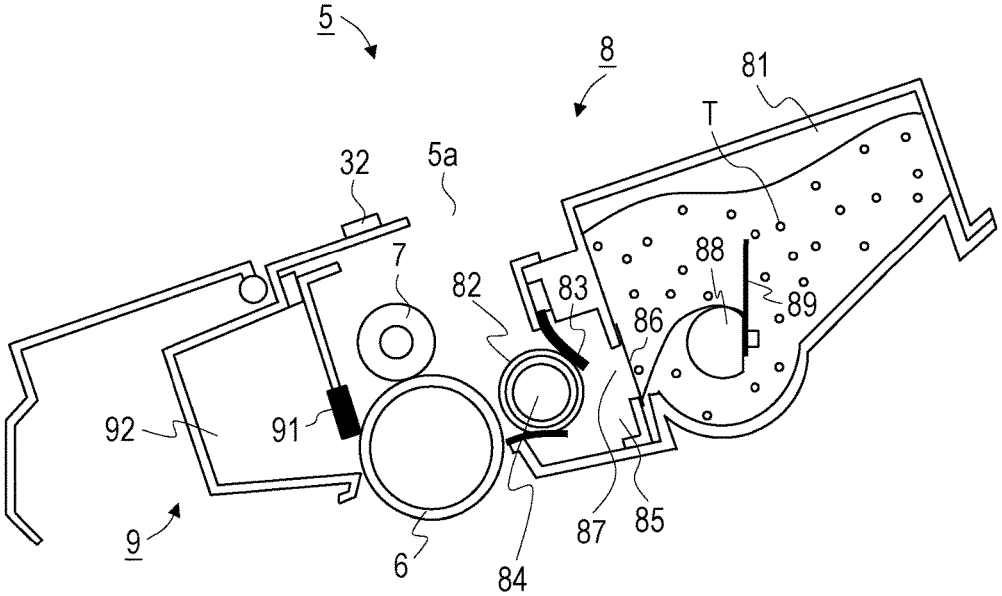
FIGS. 9A and 9B are sectional views of a cartridge according to the second embodiment.

FIG. 8 is a sectional view of the image forming apparatus 1 according to a second embodiment. FIG. 9A is a sectional view of a new cartridge 5 before the opening is unsealed by winding the toner sealing member 86.

The rotation of the axis of rotation 88 peels the toner sealing member 86 from the frame so that the opening 87 can be unsealed. When a lower end side of the toner sealing member 86 with respect to the opening 87 is peeled, the opening 87 can partially be unsealed. When the opening 87 is partially unsealed, partial toner T can be moved to the development chamber 85.

When an upper end side of the toner sealing member 86 with respect to the opening 87 is peeled from the frame, the peeling of the toner sealing member 86 completes, and the opening 87 is completely unsealed. A conveying member 87 which conveys toner is fixed to the axis of rotation 88 in addition to the toner sealing member 86. The conveying member 87 according to this embodiment is a sheet-shaped member made of PPS. The rotation of the axis of rotation 88 rotates the conveying member 87 so that the toner T can be conveyed from the developer storage chamber 81 to the development chamber 85 through the opening 87. The axis of rotation 88 rotates in an interlocking manner with the photoconductive drum 6 and the developing sleeve 82. In other words, the unsealing of the opening by the movement of the toner sealing member 86 interlocks with the rotation of the developing sleeve 82 being a developer bearing member. This embodiment is configured such that the toner sealing member 86 is wound around the axis of rotation 88 within the developer storage chamber 81 to unseal the opening. However, embodiments of the present disclosure are not limited to the configuration, but the toner sealing member 86 may be moved in an interlocking manner with the rotation of the developing sleeve 82 being a developer bearing member to unseal the opening. For example, the axis of rotation interlocking with the rotation of the developing sleeve 82 may be provided within the development chamber 85, and the toner sealing member 86 may be wound around the axis of rotation to unseal the opening.

A part at a lower position in the gravitational direction of the developing sleeve 82 of the cartridge 5 according to this embodiment is at a lower position than a part at a lower position in the gravitational direction of the opening 87. In this cartridge configuration, the toner T can move to the development chamber 85 because of gravity earlier than a time when the toner sealing member 86 starts to partially unseal the opening 87. The toner T moved to the development chamber 85 is supplied earlier to the developing sleeve 82 because of magnetic force of the magnet roller 84.

Figure 9B:
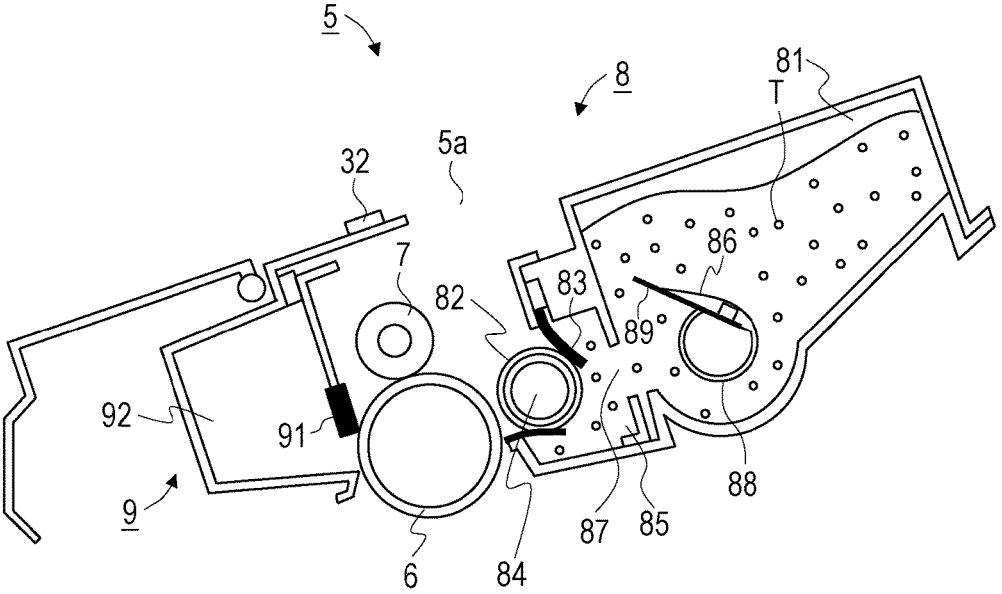

FIG. 9B is a sectional view of the cartridge 5 after the toner sealing member 86 moves to unseal the opening. When the toner T is conveyed to the development chamber 85 and the developing sleeve 82 is coated by the toner T up to a predetermined layer thickness, the cartridge 5 is ready for image forming.

According to this embodiment, the toner T acting as a lubricant is supplied to the contact portion between the developing sleeve 82 and the developing blade 83 earlier than the unsealing of the toner sealing member 86 starts. Thus, the timing for changing the driving speed of the driving motor from the second driving speed to the first driving speed can be set earlier than that in the first embodiment.

Figure 10A:
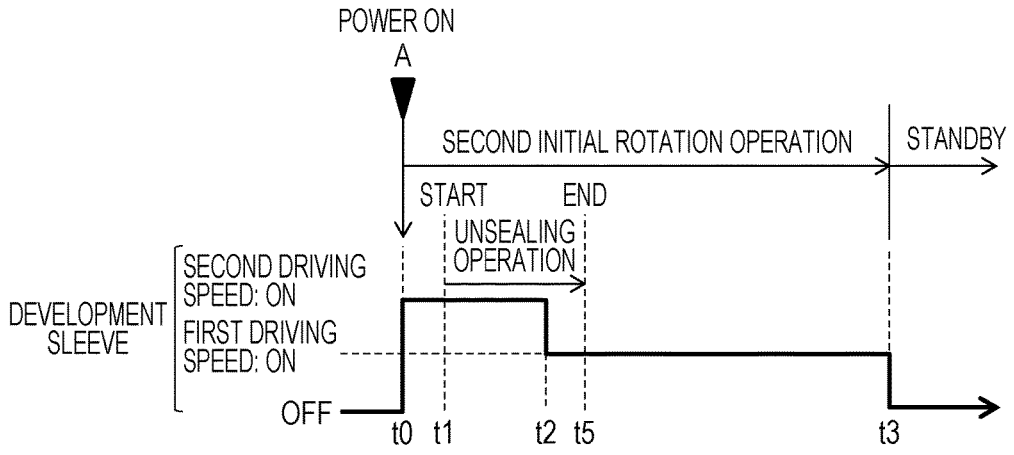
FIGS. 10A and 10B illustrate timing charts for initial rotation operations according to the second.
Figure 10B:
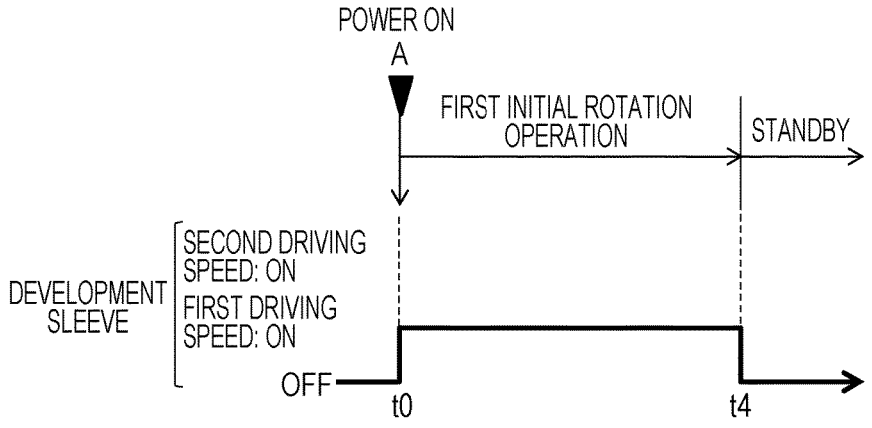

FIG. 10A illustrates a timing chart of a second initial rotation operation (between t0 and t3), and FIG. 10B is a timing chart of a first initial rotation operation (between t0 and t4).

In the first initial rotation operation, when the image forming apparatus is powered on, the developing sleeve 82 rotates at the first sleeve driving speed so that the image forming preparation operation is executed during a time period from t0 to t4.

In the second initial rotation operation, the toner sealing member 86 is peeled from the frame at t1 to start unsealing of the opening (start of unsealing operation). At t2, the driving speed of the driving motor is changed to the first driving speed being a speed in the image-forming period and being lower than the second driving speed. The time t2 is set after a predetermined time period for bringing the toner T as a lubricant to the contact portion between the developing sleeve 82 and the developing blade 83. After the image forming preparation operation ends, the image forming apparatus has a standby state. When the image forming start signal S is input in the standby state, image forming is performed at the first driving speed.

A predetermined time is set as the time t2 based on the configuration of the cartridge 5 because, more specifically, the time t2 depends on the positional relationship between the developing sleeve 82 and the opening 87. A shorter time period from t0 to t2 can reduce the time period for the second initial rotation operation and can reduce the time period until image forming is performed.

In the cartridge 5 according to this embodiment, the time when the toner T is supplied to the contact portion between the developing sleeve 82 and the developing blade 83 is earlier than the time when the unsealing of the toner sealing member 86 completes. Therefore, the time t2 may be set to a time before the time (t5) when the unsealing completes. According to this embodiment, at an earlier time, the image forming preparation operation can be performed at the first driving speed being a driving speed for the image-forming period, which can reduce the time period for the second initial rotation operation. In other words, the time period until the image forming is performed.

In other words, changing the driving speed of the driving motor to the second driving speed during a time period from a time before the unsealing operation starts to the starting time can effectively reduce occurrence of unusual noise. Having described, according to the aforementioned embodiments, the driving speed is changed to the second driving speed after the image forming apparatus is powered on (or power is supplied thereto), embodiments of the present disclosure are not limited thereto. For example, after the image forming apparatus is powered on and 5 seconds to 20 seconds before the unsealing operation is started, the driving speed may be increased.

This embodiment can provide an image forming apparatus at low cost with improved usability which does not require a user to unseal the toner sealing member and which can prevent occurrence of unusual noise.

Other Embodiments

The aforementioned embodiments assume that a lubricant is not applied over a developing sleeve being a developer bearing member when a new cartridge is attached to the image forming apparatus. However, embodiments of the present disclosure are not limited thereto. Toner may function as lubricant, but a small amount of toner may be adhered on to a developing sleeve. In such a case, unusual noise may occur because the toner does not fully exhibit a lubricant property. Therefore, the changing of the driving speed according to the present disclosure is effective.

According to the aforementioned embodiments, the developing sleeve 82 is moved at 200 mm/s in the unsealing operation of the toner sealing member 86. However, embodiments of the present disclosure are not limited thereto. For example, the developing sleeve 82 may be driven at a speed of 160 mm/s in the image forming apparatus with reference to the table in FIG. 5. This can advantageously reduce the volume of unusual noise though unusual noise can be removed. In other words, the effect can be obtained in a fixed manner by rotating the developing sleeve 82 at a speed with which the volume of unusual noise can be reduced.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-024416 filed Feb. 13, 2017, which is hereby incorporated by reference herein in its entirety.

What is claimed is:

1. An image forming apparatus comprising:

a developer bearing member configured to bear a developer;

a developing blade in contact with the developer bearing member, the developing blade regulating a layer thickness of the developer on the developer bearing member;

a development chamber including the developer bearing member;

a developer storage chamber storing the developer and having an opening for conveying the developer to the development chamber;

a sealing member configured to seal the opening, the sealing member being capable of being moved in an interlocking manner with driving of the developer bearing member to perform an unsealing operation for unsealing the opening;

a driving motor configured to drive the developer bearing member; and a control unit configured to control the driving motor to cause the developer bearing member to drive at a first driving speed while an image forming operation is being performed, wherein the control unit controls the driving motor from a time before the unsealing operation starts to a starting time to drive the developer bearing member at a second driving speed higher than the first driving speed.

2. The image forming apparatus according to claim 1, wherein the control unit controls the driving motor at the second driving speed during the unsealing operation.

3. The image forming apparatus according to claim 1, further comprising:

a cartridge including the developer bearing member, the development chamber, the developer storage chamber, and the sealing member, wherein the cartridge is detachably attached to the image forming apparatus.

4. The image forming apparatus according to claim 3, further comprising:

a detecting unit configured to detect whether the cartridge is new or not, wherein, in a case where the detecting unit detects that the cartridge is new, the control unit starts the unsealing operation.

5. The image forming apparatus according to claim 4, wherein the cartridge has a storage member configured to store information regarding the cartridge.

6. The image forming apparatus according to claim 5, wherein the detecting unit obtains information regarding the cartridge stored on the storage member and detects whether the cartridge is new or not.

7. The image forming apparatus according to claim 4, wherein, in a case where the detecting unit detects that the cartridge is new, the control unit controls the driving motor to drive the developer bearing member at the second driving speed and then to drive the developer bearing member at the first driving speed after the unsealing operation starts and before the unsealing operation completes.

8. The image forming apparatus according to claim 3, wherein, in a case where the detecting unit detects that the cartridge is new, the control unit controls the driving motor to drive the developer bearing member at the second driving speed and then to drive the developer bearing member at the first driving speed after the unsealing operation starts and before an image forming operation is started.

9. The image forming apparatus according to claim 1, wherein the control unit controls the driving motor to drive the developer bearing member at the first driving speed after the unsealing operation starts and before an image forming operation starts so that a preparation operation for performing the image forming operation is performed.

10. The image forming apparatus according to claim 1, wherein the control unit also functions as a detecting unit.

11. The image forming apparatus according to claim 1, wherein the control unit controls the driving motor to drive the developer bearing member at the second driving speed before the unsealing operation starts.

12. The image forming apparatus according to claim 1, wherein the developer bearing member has a first part, which is at a lower portion of the developer bearing member in a gravitational directions;

the opening has a second part, which is at a lower portion of the opening in the gravitational direction;

and wherein in the gravitational direction the first part is located at a position lower than the second part.

13. A control method for an image forming apparatus, the apparatus having a developer bearing member configured to bear a developer;

a developing blade in contact with the developer bearing member, the developing blade regulating a layer thickness of the developer on the developer bearing member;

a development chamber having the developer bearing member;

a developer storage chamber storing the developer and having an opening for conveying the developer to the development chamber;

a sealing member configured to seal the opening;

a driving motor configured to drive the developer bearing member; and a control unit configured to control the driving motor to cause the developer bearing member to drive at a first driving speed while an image forming operation is being performed, the method comprising:

controlling, by the control unit, the driving motor from a time before the unsealing operation starts to the starting time to drive the developer bearing member at a second driving speed higher than the first driving speed.

14. The control method according to claim 13, wherein the controlling controls the driving motor at the second driving speed during the unsealing operation.

* * * * *